US007654493B2

(12) United States Patent
Figueroa

(10) Patent No.: US 7,654,493 B2
(45) Date of Patent: Feb. 2, 2010

(54) DUAL OPENING REFUSE GATHERING APPARATUS

(76) Inventor: Jose Francisco Figueroa, 23 E. Second St., Clifton, NJ (US) 07011

( * ) Notice: Subject to any disclaimer, the term of this patent is extended or adjusted under 35 U.S.C. 154(b) by 296 days.

(21) Appl. No.: 11/423,571

(22) Filed: Jun. 12, 2006

(65) Prior Publication Data

US 2006/0289703 A1 Dec. 28, 2006

(30) Foreign Application Priority Data

Jun. 22, 2005 (PE) ..... 000710-2005OIN

(51) Int. Cl.
*B65B 67/12* (2006.01)

(52) U.S. Cl. ..... 248/95; 248/99; 15/257.3

(58) Field of Classification Search ..... 248/95, 248/99; 15/257.3, 257.4; 53/258, 390; 294/1.1
See application file for complete search history.

(56) References Cited

U.S. PATENT DOCUMENTS

D309,966 S * 8/1990 Bishop ..... D34/5
5,924,162 A * 7/1999 Kalscheur et al. ..... 15/257.2
D440,729 S * 4/2001 Piner et al. ..... 15/257.2
6,233,780 B1 * 5/2001 Mead ..... 15/257.3
6,450,461 B1 * 9/2002 Lohmann ..... 248/99
6,679,948 B2 * 1/2004 Mead ..... 134/6
6,902,060 B2 * 6/2005 Michelson et al. ..... 206/576

* cited by examiner

*Primary Examiner*—Amy J Sterling
(74) *Attorney, Agent, or Firm*—Hitchcock Evert LLP

(57) ABSTRACT

A dual opening refuse gathering apparatus and method for gathering debris and particulate matter is disclosed. The apparatus can be used to clean debris from a variety of surfaces, including but not limited to tables, floors, and streets. The invention disclosed includes a structure with an entrance opening and exit opening to collect then dispose of debris. The invention may be used with an attached gripping unit and/or an attached container. The method of use disclosed involves the collection of debris into the entrance opening and disposal of the debris through the exit opening into an attached container.

21 Claims, 6 Drawing Sheets

DUAL OPENING REFUSE GATHERING APPARATUS

FIELD OF THE INVENTION

The invention relates to the collection of debris and particulate matter. More particularly, the invention relates to a method and apparatus for collecting debris and particulate matter from a substantially horizontal surface into a container.

BACKGROUND OF THE INVENTION

Dust pans are used in all kinds of places where clean surfaces are desired and/or required, such as parks, streets, stadiums, buildings, stairs, schools, and other public and private places. People still rely on conventional right angle dust pans to collect and dispose of debris and particulate matter when other manners of cleaning are more difficult to use or inoperable because of the absence of, or lack of access to, electrical power or other manners of cleaning are not feasible or preferable because of economic reasons.

Users of a conventional dustpan must pick up the trash until the dust pan surface becomes completely full and then must dump the trash into a container or trash can, then repeat the process until the area is clean. The problem arises when the user has to clean surfaces away from a container or trash can, because the user must to walk back and forth with the dustpan to where the container or trash can is located, or push or pull the container or trash can to the areas where the user is cleaning. This extra work makes the user more inefficient by wasting time and effort in disposing of the collected debris or particulate matter.

This problem is compounded by the restricted capacity of the dust pan, because the limited capacity causes the user to repeat the process of collecting and dumping the trash into a container or trash can as many times as is needed to clean the area. The lack of capacity can also lead to the user fatigue. Specifically, in order to save capacity, a user may pick up larger objects, such as bottles, cans, papers, or any other large debris, and in doing so, the user bends their body constantly and as needed to pick up the larger items, leading to fatigue.

SUMMARY OF THE INVENTION

The present invention is an efficient device for collecting debris and particulate matter from a variety of surfaces. It avoids unnecessary trips to a trash container, increases hygiene by diminishing contact with the garbage, and increases the capacity for large items through the use of an attached container. This invention can save users substantial effort, energy, and time, translating into economic savings, since the collection and emptying of debris into the container is immediate and in the same place as the debris or garbage is found.

The invention includes a structure, a container attachment mechanism, and a gripping portion. The structure has an entrance opening for collecting debris and particulate matter, and has an exit opening for dumping the collected debris and particulate matter into a container. For description purposes only, the front is the side where the entrance opening is located, the bottom is a horizontal surface closest to the surface to be cleaned when in use, and the top member is located at a position such that the debris will pass underneath it while the apparatus is in use. The entrance opening is defined by the front edge of each of two side walls, the front edge of the top member and the front edge of the horizontal surface. The exit opening is defined by either the back or top edge of each side wall, the back edge of the top member, and the top edge of the rear wall.

Attached to the exit opening is a container, such as a bag or any other item that has at least one opening and can hold debris and/or particulate matter. Also, attached to the structure is a gripping unit having one end attached to the structure and the other end standing out from the structure to provide a grip point for the user, a gripping unit having two or more opposing ends attached to the structure with a grip area between the ends of the gripping unit could also be employed.

The apparatus works by moving debris into the entrance opening of the apparatus by any known or yet to be discovered method, then tilting the apparatus backwards, far enough to allow gravity to move the debris inside of the apparatus into the attached container. The apparatus may be lifted when tilting for the ease of an operator. The container can then be removed and emptied or disposed of altogether, and a new container can be attached for additional cleaning.

In one embodiment, the container is a bag that is attached to the exit opening by tying the bag around a lip that outlines the opening. The lip surrounding the opening is either made up of individual lips on each of the corresponding edges of the top member, side walls, and rear wall, or is a separate piece that is attached to the corresponding edges of the top member, side walls, and rear wall. The bag can then be removed by untying it and lifting it off the lip.

Another embodiment includes an elongated gripping unit to permit use of the apparatus while standing. A broom, or any other method of moving debris into the apparatus, can be used to fill the apparatus, then the apparatus can be lifted and tilted to allow gravity to pull any debris in the apparatus into the attached container. The invention may have a short gripping unit to permit use in confined areas or on raised surfaces. The invention may also be designed to have a grip attachment device to allow alternative gripping units to be interchanged as desired depending on the work the user is engaged in.

In another embodiment of the invention, the horizontal surface has a triangular front edge to facilitate the collection of debris. The shape of the horizontal surface's front edge can vary and remain within the scope and spirit of the invention and different shapes may be better suited for different applications. The shapes of any of the edges may also vary and remain within the scope and spirit of the invention.

Other embodiments may change the size of the apparatus, any angles or shape of the walls, or length of the gripping units and remain within the scope and spirit of the invention. Changes in each of these attributes may be useful in better suiting the apparatus for specific tasks, such as a long gripping unit and large apparatus for use in cleaning large ground spaces, a short gripping unit and smaller apparatus for cleaning raised surfaces, or any other variations necessary to meet the intended use of the specific apparatus. The invention may also be used to collect debris without an attached container. The embodiments described may be combined in part or in whole and still remain within the scope and spirit of the invention.

FIGURES

The present invention will be more fully understood from embodiments of the invention described in the detailed description together with the drawings provided to aid in understanding, but not to limit the invention:

DETAILED DESCRIPTION

The orientational language used to describe the various embodiments of the invention remains consistent throughout and can be determined by the entrance opening defined as the front side, and the horizontal surface defined as the bottom. The term debris includes any and all material that may be gathered into the structure for collection in the attached container, including but not limited to, trash, bottles, cans, particulate matter, and dirt.

Figure 1:
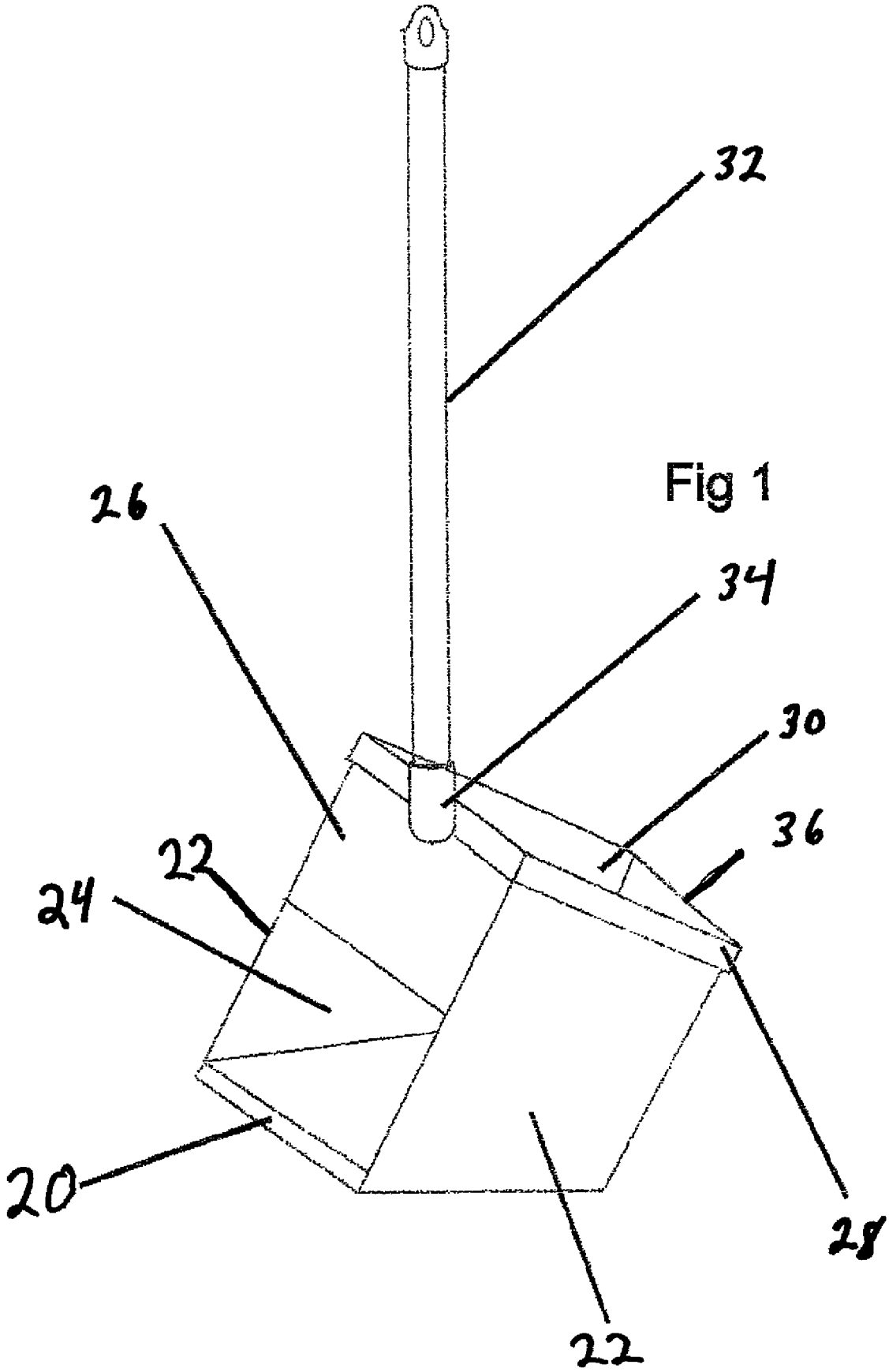
FIG. 1 is an elevated front corner view of the present invention with a long gripping unit.

FIG. 1 depicts one embodiment of the present invention. This embodiment shows the elevated front corner view of the invention. The horizontal surface 20 is located at the bottom of the invention and is attached to side walls 22 and the rear wall 36. The entrance opening 24 is defined by horizontal surface 20, side walls 22, and top member 26. The exit opening 30 is defined by rear wall 36, side walls 22, and top member 26. Exit opening 30 is outlined by lip 28. Lip 28 can be made by creating an outward lip on all of the corresponding edges of side walls 22, rear wall 36, and top member 26, or lip 28 can be a separate piece that attaches to the corresponding edges of side walls 22, rear wall 36, and top member 26. The grip attachment 34 is shown attached to top member 26, and has gripping unit 32 shown attached to grip attachment 34. Grip attachment 34 may be threaded, pinned, clipped, or attached by any other means which allows gripping unit 32 to remain fixed to the structure or to be removable and, thus, interchangeable with other gripping units. Gripping unit 32 has a base end that attaches to grip attachment 34 in a manner corresponding to the attachment mechanism employed by grip attachment 34.

Figure 2:
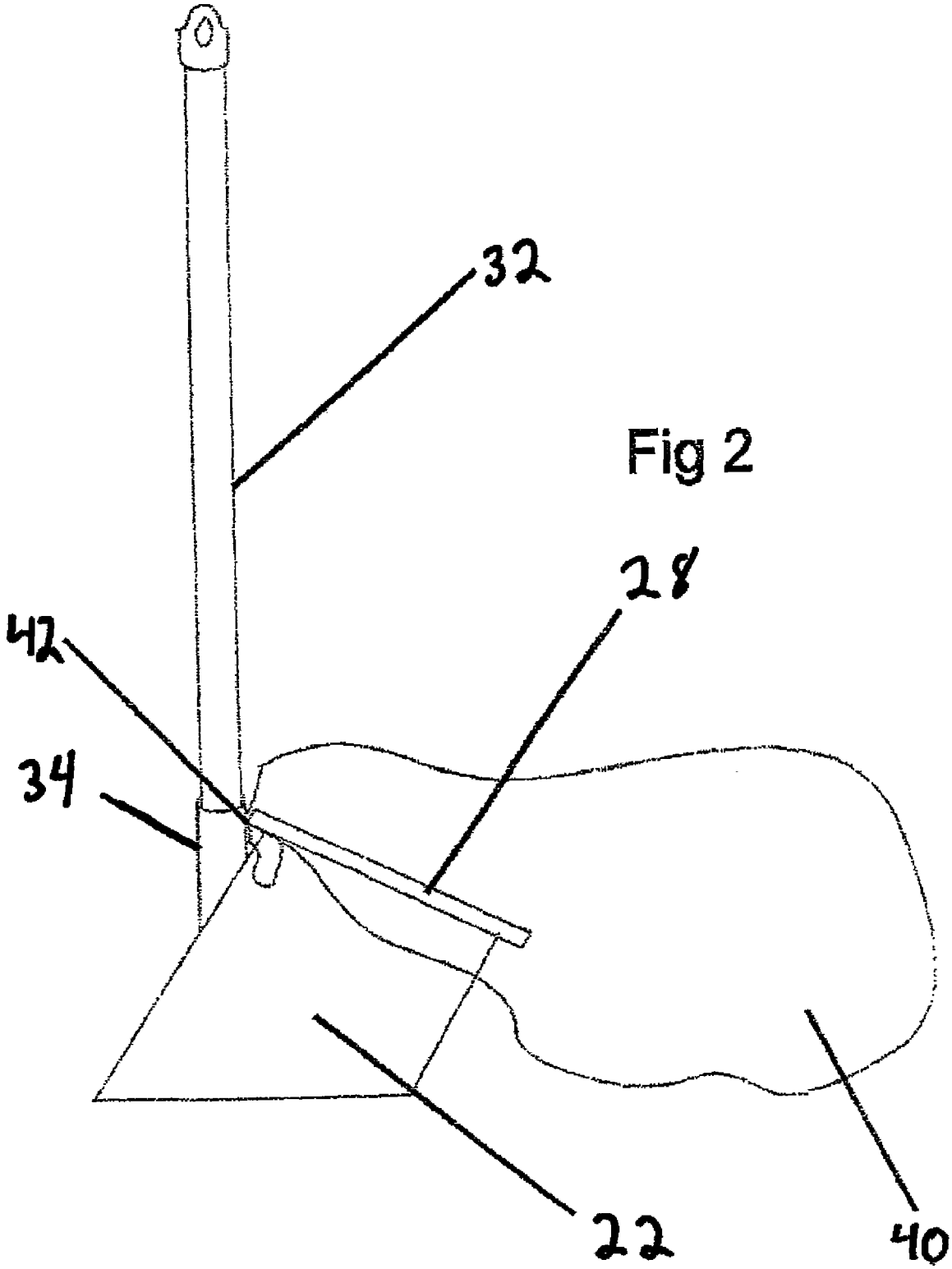
FIG. 2 is a side view of the present invention.

FIG. 2 depicts the invention from a side view with an attached container 40. Container 40 is shown at the back of the invention, and is attached around exit opening 30 by securing container 40 around lip 28. Container 40 can be a bag or any other known or yet to be discovered container for holding debris. Container 40 has at least one container opening to correspond to exit opening 30, but it may have other openings, such as an opening to remove the debris from container 40 without removing it from the container attachment apparatus shown as lip 28. This figure also depicts a gap 42 between the lip 28 and the grip attachment 34 to allow the container 40 to be secured all the way around the lip 28. Gap 42 is not a necessary element and may not be useful in any embodiment of the invention that uses a different container attachment apparatus or employs a different shape of structure for the invention.

Figure 3:
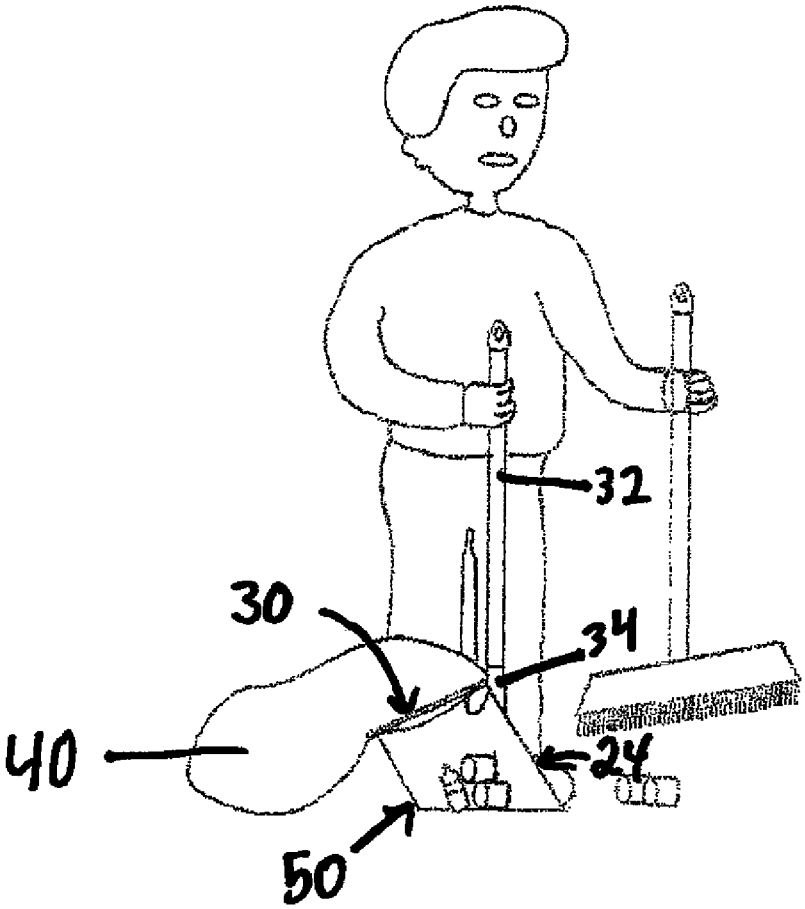
FIG. 3 is a side view of the present invention with a user moving debris into the invention.
Figure 4:
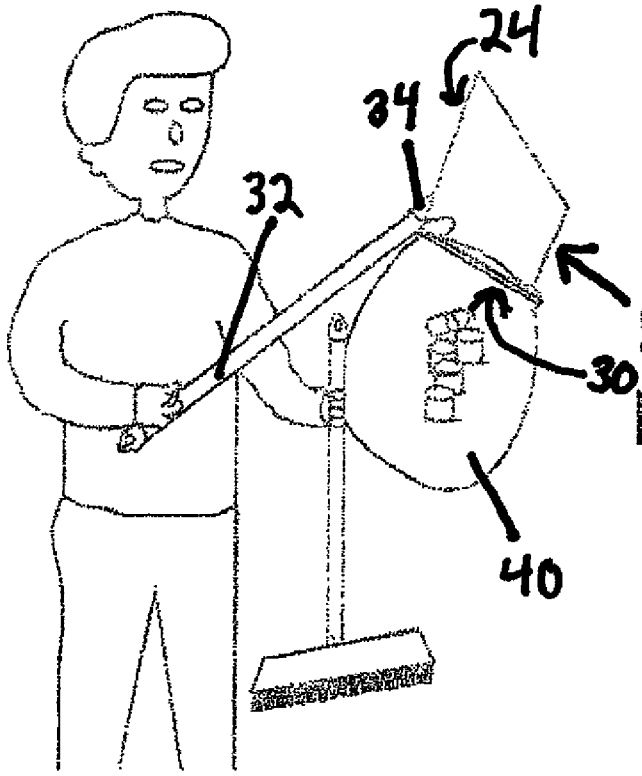
FIG. 4 is a side view of the present invention with a user tilting the invention to dump debris into the container.
Figure 5:
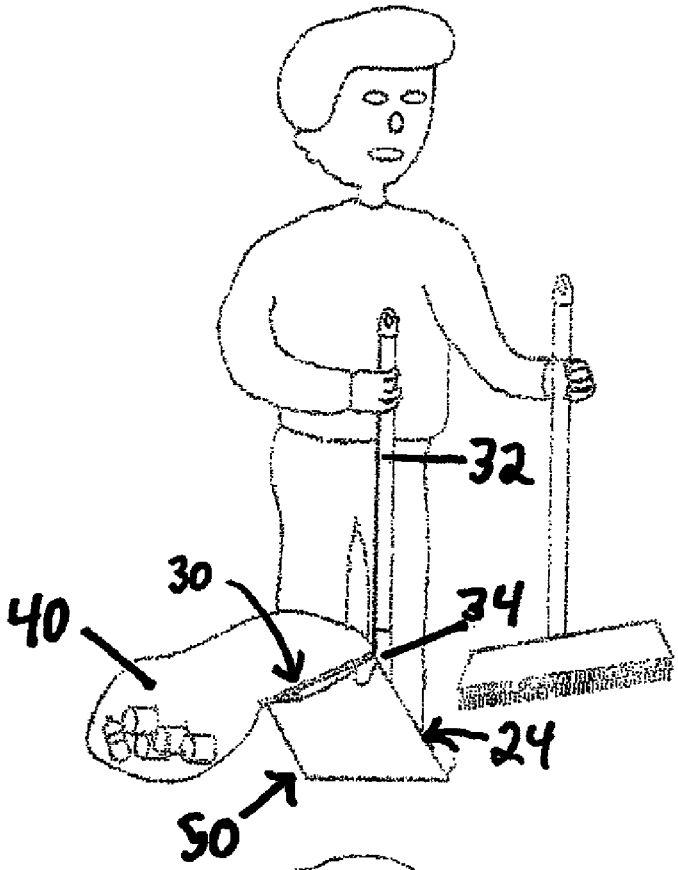
FIG. 5 is a side view of the present invention with a user continuing use after collecting debris in the container.
Figure 6:
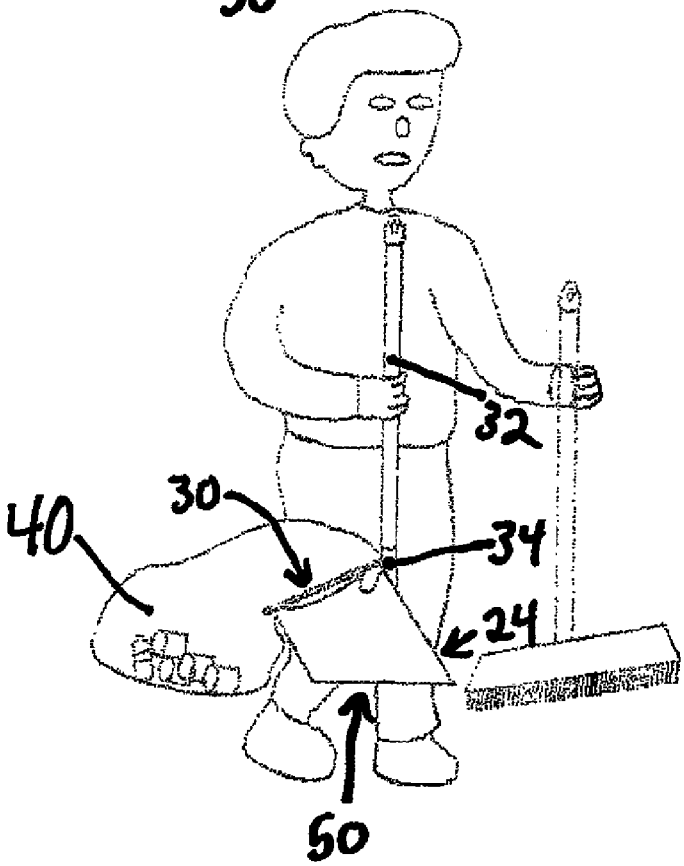
FIG. 6 is a side view of the present invention being transported by the user with debris in the container.

FIGS. 3 through 6 depict use of the invention with an open side, for illustration purposes. The user is holding gripping unit 32, which is attached the structure 50 by grip attachment 34. Container 40 is attached to exit opening 30 of the structure. In FIG. 3, the user gathers the debris into structure 50 through entrance opening 24. In FIG. 4, the user tilts structure 50 while lifting it and attached container 40. The tilting of structure 50 causes the debris to fall out of structure 50, through exit opening 30 into the container 40. In FIG. 5, the user has returned structure 50 to an operational position, showing the debris now in container 40 and structure 50 empty and useful for collecting more debris. FIG. 6 depicts the user moving with the collected debris remaining in container 40.

Figure 7:
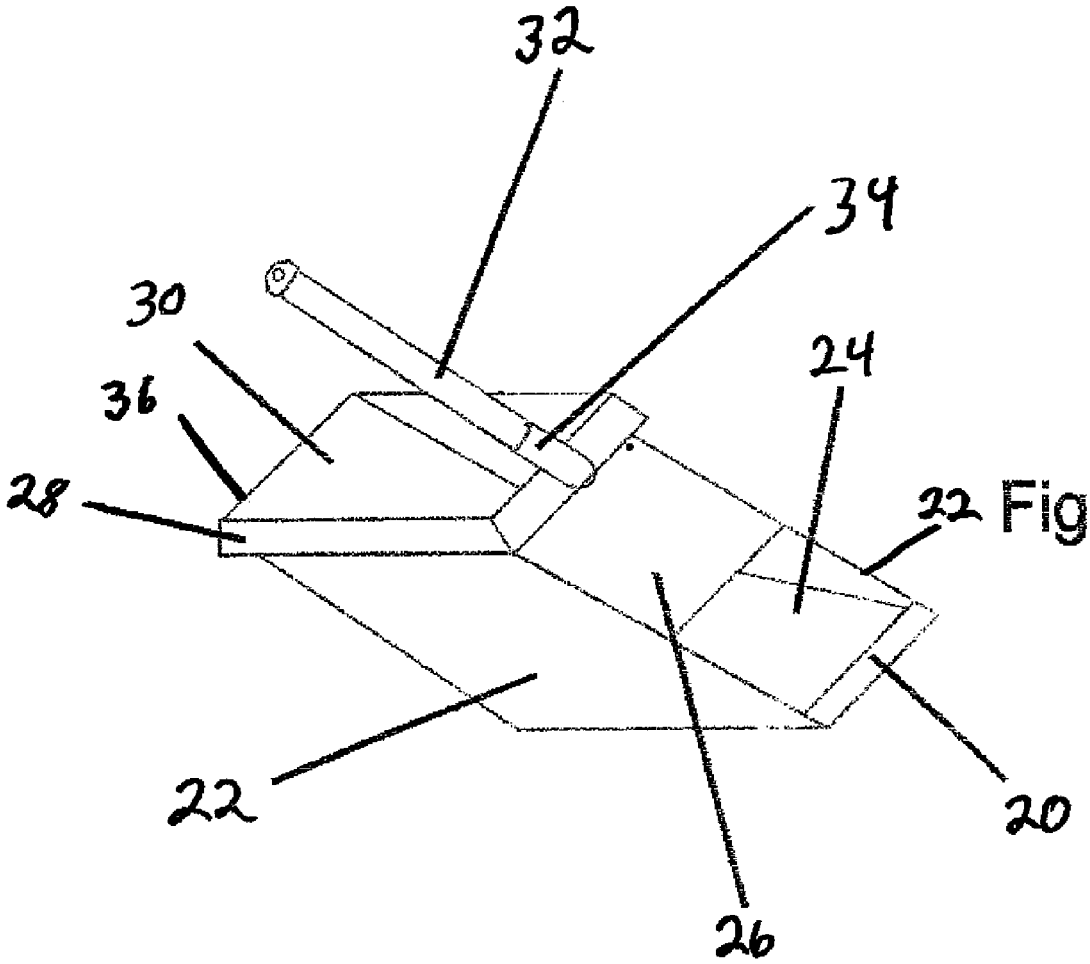
FIG. 7 is an elevated front corner view of the present invention with a short gripping unit.

FIG. 7 depicts an embodiment similar to FIG. 1 from a different perspective. The main differences shown are the shorter gripping unit 32 and the different shape of side walls 22. Entrance opening 24 and exit opening 30 are used for the same purposes as described above. The shorter gripping unit 32 shown is attached to grip attachment 34, and may provide for fixed or interchangeable gripping units by removable attachment mechanisms, such as changing out a long gripping unit for a short gripping unit.

Figure 8:
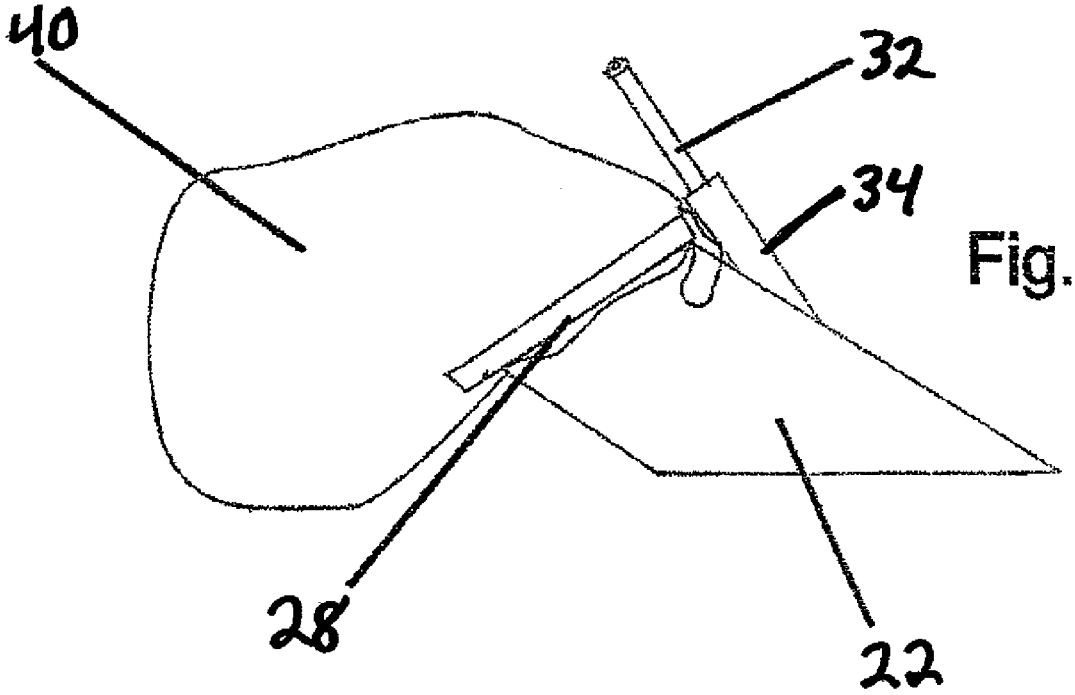
FIG. 8 is a side view of the present invention with a short gripping unit.

FIG. 8 shows the embodiment of FIG. 7 from a side view and with an attached container 40. The view shows the changed shape of the side walls 22 and angles used in the apparatus.

Figure 9:
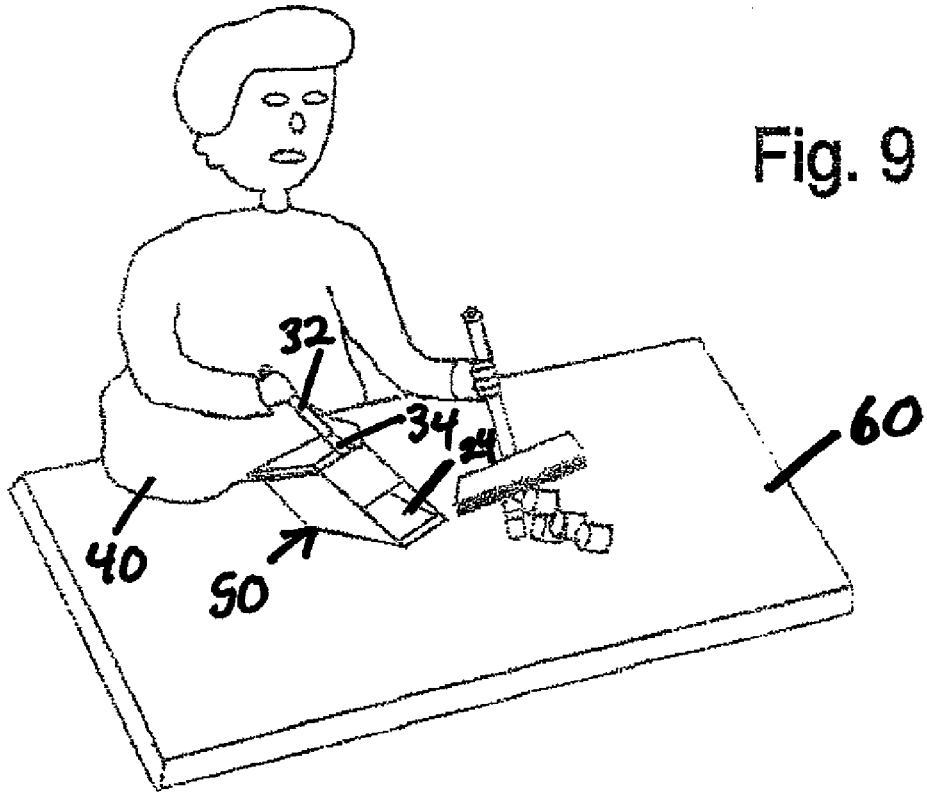
FIG. 9 is an elevated front corner view of the present invention with a short gripping unit with a user moving debris into the invention off a raised surface.

FIG. 9 depicts the use of the invention from FIG. 7 on a raised surface 60. The user is gathering debris into structure 50 through entrance opening 24. The user holds short gripping unit 32 which controls structure 50 by grip attachment 34.

This embodiment shows top member 26 as a rectangular wall, but top member 26 may be any variety of shapes that can be used to maintain the structure and openings, or the top member may not be included is some variations of the invention. All the walls and surfaces may also vary in shape and size and still create the dual openings for the gathering and disposing of debris into a container. Attachment can include any manner or device for creating or maintaining a connection between two items whether flexible, rigid, or removable, such as by adhesives, fasteners, making all components out of one continuous material, threading, or any other known or yet to be discovered attachment method or device.

In another embodiment, the apparatus may be used for debris collection without an attached container.

What is claimed is:

1. A debris collection apparatus comprising:

(a) a gripping portion;

(b) a structure attached to said gripping portion, having:

(i) a horizontal surface having a front, back, and two sides;

(ii) a pair of side walls, one attached to each of the two said sides of the horizontal surface;

(iii) a rear wall attached to said back of said horizontal surface and each of said side walls;

(iv) a top member attached to each of said side walls;

(v) an entrance opening adjacent to said front of said horizontal surface;

(vi) an exit opening adjacent to said rear wall, wherein said exit opening is proportioned such that debris that passes through said entrance opening can then pass through said exit opening; and (c) a container attachment apparatus attached to the structure;

wherein said horizontal surface has at least a portion of the edge adjacent to said entrance opening with a triangular shape.

2. A debris collection apparatus as in claim 1, wherein said container attachment apparatus comprises a lip surrounding said exit opening.

3. A debris collection apparatus as in claim 1, wherein said container attachment apparatus is attached to said exit opening of said structure.

4. A debris collection apparatus as in claim 1, wherein said container attachment apparatus comprises at least one cleat adjacent to said exit opening.

5. A debris collection apparatus as in claim 4, wherein said container attachment apparatus further comprises a lip surrounding said exit opening.

6. A debris collection apparatus comprising:

(a) a gripping portion;

(b) a structure attached to said gripping portion, having:

(i) a horizontal surface having a front, back, and two sides;

(ii) a pair of side walls, one attached to each of the two said sides of the horizontal surface;

(iii) a rear wall attached to said back of said horizontal surface and each of said side walls;

(iv) a top member attached to each of said side walls;

(v) an entrance opening adjacent to said front of said horizontal surface;

(vi) an exit opening adjacent to said rear wall, wherein said exit opening is proportioned such that debris that passes through said entrance opening can then pass through said exit opening; and (c) a container attachment apparatus attached to the structure;

wherein said rear wall creates an obtuse angle with said horizontal surface.

7. A debris collection apparatus as in claim 6, wherein said gripping portion comprises a gripping unit having one or more base ends attached to said structure and one or more grip ends opposite from the base end.

8. A debris collection apparatus as in claim 6, wherein said top member, side walls, and rear wall form said exit opening of said structure.

9. A debris collection apparatus as in claim 8, wherein said container attachment apparatus comprises a lip surrounding said exit opening.

10. A debris collection apparatus as in claim 6, wherein said container attachment apparatus is attached to said exit opening of said structure.

11. A debris collection apparatus as in claim 6, wherein said container attachment apparatus comprises connecting devices.

12. A debris collection apparatus as in claim 10, wherein a container is removably attached to said container attachment apparatus.

13. A debris collection apparatus as in claim 12, wherein said container comprises at least one container opening and at least one of said container openings is operatively associated with the exit opening of said structure.

14. A debris collection apparatus as in claim 6, wherein said top member is attached to a grip attachment device.

15. A debris collection apparatus as in claim 14, wherein said gripping portion is removably attachable to said grip attachment device.

16. A debris collection apparatus as in claim 6, wherein said side walls are substantially parallel.

17. A debris collection apparatus as in claim 6, wherein said structure is removably attachable to a container by said container attachment apparatus.

18. A debris collection apparatus as in claim 17, wherein said container is made of a flexible material.

19. A debris collection apparatus as in claim 6, wherein said container attachment apparatus comprises at least one cleat adjacent to said exit opening.

20. A debris collection apparatus as in claim 19, wherein said container attachment apparatus further comprises a lip surrounding said exit opening.

21. A debris collection apparatus as in claim 6, wherein said horizontal surface has at least a portion of the edge adjacent to said entrance opening with a triangular shape.

* * * * *